US007755878B2

(12) United States Patent
Van Wyk et al.

(10) Patent No.: US 7,755,878 B2
(45) Date of Patent: Jul. 13, 2010

(54) BLAST KEY

(75) Inventors: Riaan Lingenfelder Van Wyk, Pretoria (ZA); Graham A. Garside, Springs (ZA)

(73) Assignee: Detnet South Africa (PTY) Ltd. (ZA)

( * ) Notice: Subject to any disclaimer, the term of this patent is extended or adjusted under 35 U.S.C. 154(b) by 0 days.

(21) Appl. No.: 10/578,830

(22) PCT Filed: Oct. 26, 2004

(86) PCT No.: PCT/ZA2004/000130

§ 371 (c)(1),
(2), (4) Date: Jan. 19, 2007

(87) PCT Pub. No.: WO2005/045353

PCT Pub. Date: May 19, 2005

(65) Prior Publication Data

US 2007/0186796 A1 Aug. 16, 2007

(30) Foreign Application Priority Data

Nov. 10, 2003 (ZA) ..... 03/8754

(51) Int. Cl.
*F23Q 7/00* (2006.01)

(52) U.S. Cl. ..... 361/248; 102/202.1

(58) Field of Classification Search ..... 361/248, 361/252, 247; 102/202.1
See application file for complete search history.

(56) References Cited

U.S. PATENT DOCUMENTS

| | | | | |
|---|---|---|---|---|
| 3,721,860 | A * | 3/1973 | Phinney | 361/251 |
| 5,517,920 | A * | 5/1996 | Hinz et al. | 102/215 |
| 6,422,147 | B1 * | 7/2002 | Shann | 102/312 |
| 6,490,977 | B1 * | 12/2002 | Bossarte et al. | 102/342 |
| 6,644,202 | B1 * | 11/2003 | Duniam et al. | 102/312 |
| 6,857,369 | B2 | 2/2005 | Bossarte et al. | 102/342 |
| 7,154,732 | B2 * | 12/2006 | Bennett et al. | 361/248 |
| 2003/0116048 | A1 | 6/2003 | Bossarte et al. | 102/202.5 |

FOREIGN PATENT DOCUMENTS

| | | |
|---|---|---|
| DE | 1117016 | 11/1961 |

* cited by examiner

*Primary Examiner*—Jared J Fureman
*Assistant Examiner*—Christopher J Clark
(74) *Attorney, Agent, or Firm*—Cantor Colburn LLP

(57) ABSTRACT

A blast key which includes a body and a blast energy generator in or on the body. The blast key may include a body in the form of a small housing and may further comprise a switch connected to the energy generator.

13 Claims, 1 Drawing Sheet

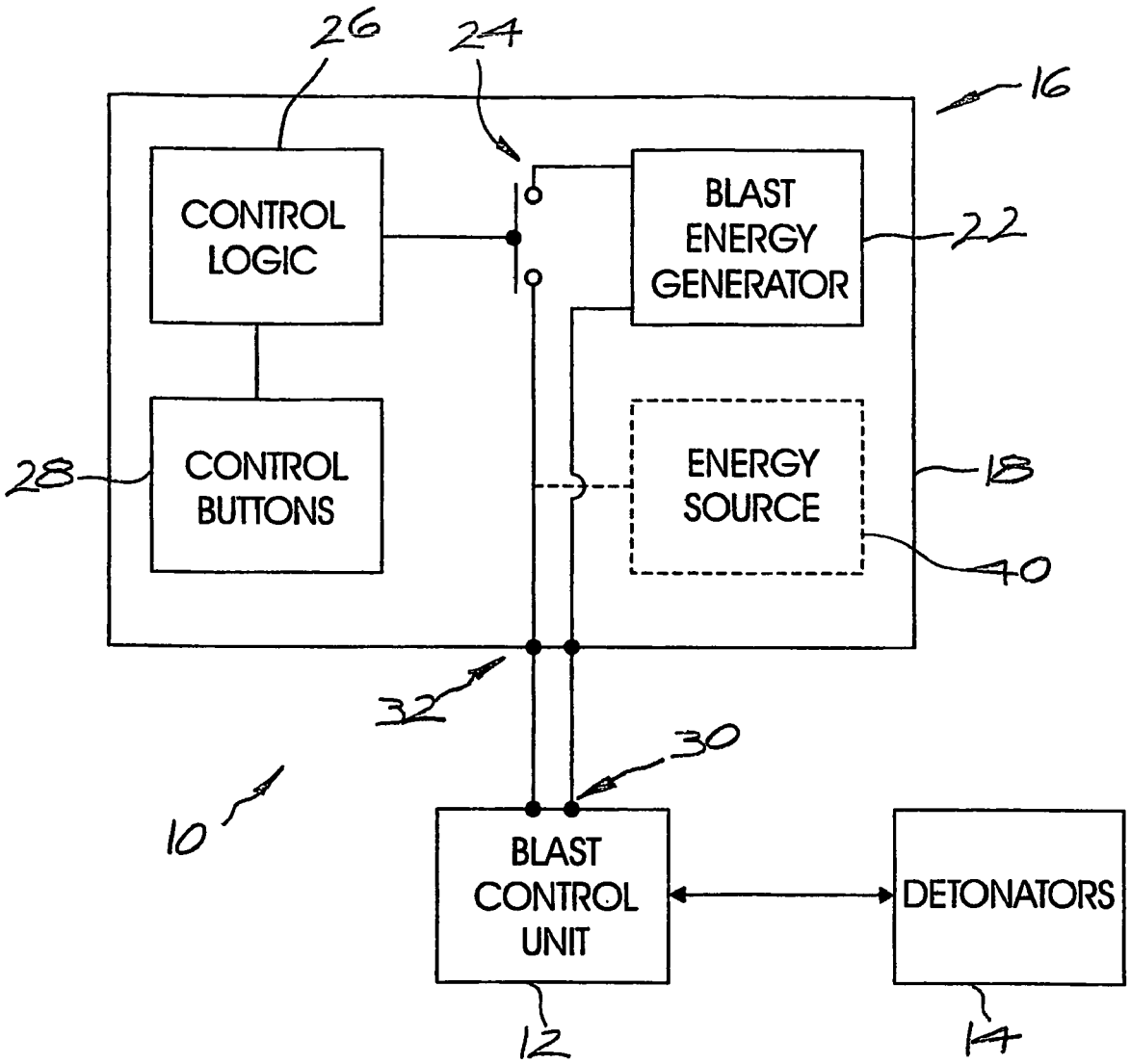
26
24
16
CONTROL LOGIC
BLAST ENERGY GENERATOR
22
28
CONTROL BUTTONS
ENERGY SOURCE
18
40
32
30
10
BLAST CONTROL UNIT
DETONATORS
12
14

BLAST KEY

This application is a U.S. national stage application of International Application No. PCT/ZA2004/000130, which claims priority to ZA 2003/8754, filed Nov. 10, 2003, incorporated by reference herein in its entirety.

BACKGROUND OF THE INVENTION

This invention relates to a blasting arrangement comprising a plurality of detonators, a blast control unit to which the detonators are connected and a blast key which is removably connected to the blast control unit.

A typical blasting arrangement includes a plurality of detonators and a blast control unit which is used for firing the detonators in a controlled manner. The blasting arrangement also includes a blast energy source and a blast key which constitutes a physical link in an electrical path between the blast energy source and the detonators. The blast key is usually constituted by a switch, a relay contact or a physically removable link. Once the blast key is in place and is connected to the remainder of the blast arrangement the detonators can be armed and fired. The blast key is removable—a characteristic which is intended to prevent unwanted or inadvertent firing of the detonators.

A drawback with a blast key of the aforementioned kind is that the blast key can fail, to a temporary or permanent closed state, due to a variety of sources, for example due to excessive vibration or shock. It is also possible for contacts, with which the blast key is to be engaged, to be short-circuited by any conductive material which accidentally bridges the contacts. Under this type of situation the blast control unit can cause an unplanned initiation of the detonators with potentially serious adverse consequences.

SUMMARY OF THE INVENTION

The present invention provides a blasting arrangement comprising a blast key which includes a body and a blast energy generator in or on the body.

The blast key may include a switch which is in series with the blast energy generator.

The switch may be manually, electrically or electromechanically controlled.

The blast key may include a logic control unit or one or more control switches or buttons for controlling the switch.

The body may be in the nature of a housing in which the blast energy generator is mounted.

The body may include a plurality of terminals to enable the blast energy generator to be connected to a blast control unit.

In one embodiment the blast key includes an energy source for actuating the blast energy generator, in a controlled manner.

The invention also provides a blasting arrangement which includes a plurality of detonators, a blast control unit, and a blast key which is removably connected, directly or indirectly, to the detonators and the blast control unit, and wherein the blast key includes a blast energy generator which provides electrical energy at a predetermined voltage for arming the detonators.

The electrical energy which is provided by the blast energy generator may be derived from an energy source which is included in the blast key or, more preferably, from an energy source which is under the control of the blast control unit.

BRIEF DESCRIPTION OF THE DRAWING

The invention is further described by way of example only with reference to the accompanying drawing which is a block diagram illustration of a blasting arrangement which makes use of a blast key according to the invention.

DESCRIPTION OF PREFERRED EMBODIMENT

The accompanying drawing illustrates a blasting arrangement 10 according to one embodiment of the present invention which includes a blast control unit 12, a plurality of detonators 14 of any appropriate kind which are connected in a desired configuration to the blast control unit 12, and a blast key 16.

The blast key may take on any of a plurality of different configurations. The blast key, in the illustrated example, includes a body 18 in the nature of a small portable housing in or on which are mounted a blast energy generator 22, a switch 24 which is connected in series to the blast energy generator, control logic 26, and a plurality of control buttons 28.

The blast control unit 12 is of a kind which is known in the art and for this reason its construction and operation are not described in detail herein. The blast control unit includes a plurality of terminals 30. The body 18 includes a corresponding plurality of terminals 32 which enable the blast key to be electrically connected to the blast control unit when required.

The body 18 is a portable device which can be removed from the blast arrangement, and which can be connected to the blast arrangement when necessary. In one example of the invention the blast control unit 12 provides energy to the blast energy generator 22, when the switch 24 (which is optional) is closed, and the blast energy generator changes the voltage of the electrical energy, using techniques which are known in the art, to a level which is suitable for arming the detonators 14. It is to be noted that, as a safety feature, the blast control unit 12 is physically incapable of directly providing energy at a suitable voltage level for arming the detonators.

As the blast energy generator 22 is physically removable, together with the body 18, from the blasting arrangement, the safety of the blasting system is enhanced. The blast control unit 12 is inherently safe and, provided the blast key 16 is not connected to the blast control unit, excessive vibration or shock or an electrical short-circuit will not put the blast control unit into a condition in which it can set off a blast of the detonators 14. This can occur only if the blast key 16 is physically engaged with the blast control unit and the blast control unit is used directly or indirectly to energise the blast energy generator.

The safety of the blast key can be further enhanced by making use of the switch 24. The switch 24 may be a manual switch, an electronic switch or an electromechanical switch. In the last two mentioned cases the switch can be controlled by means of the control logic block 26 so that the switch can only be operated if a correct logic state is present. Logic state changes can occur from different sources for example from a signal or signals input from an external control device, e.g. the control buttons or switches i.e. input devices 28 on the blast key which are manually operable or from an electrical signal or signals from other control equipment which are input to the logic unit 26 via suitable communications links connected, for example, to one or more terminals 34 on the blast key, or from both sources in combination.

The control buttons 28 can be used for functions like "arm", a control mode which causes the blast energy generator to start generating electrical energy at a suitable voltage, and "fire", a control mode which is used to initiate firing of the detonators 14.

The blast arrangement 10 is inherently safe if the blast key 16 is not engaged with the blast control unit. Once the blast key is connected to the remainder of the blast arrangement the inherent safety of the system is not compromised for the arrangement only changes to a state in which it is capable of causing blasting once the blast key receives the correct instructions from the blast control unit 12 or if the local control logic unit 26 or actuation of the control buttons 28 indicates that a correct logic state has been achieved. Either or both of the two last-mentioned conditions cause the switch 24 to close.

The detachable blast key with the on-board blast energy generator increases the shock tolerance of the blasting control equipment and eliminates problems which can arise with prior art devices which have physical contacts which can be shorted or, in the case of a relay, which have contacts which are "sticky" and do not automatically return to normally open.

It is not usually possible for the blast key to power itself. Instead the blast key relies on other control equipment e.g. the blast control unit, to provide it with energy. With this configuration the blast key is therefore inherently safe as a unit when it is disconnected from the blast arrangement.

It is possible, nonetheless, for the blast key to include an "on-board" energy source 40 which is shown in dotted lines. The source cannot energise the blast energy generator 22 until the switch 24 is closed. An interlock can readily be provided to ensure that the switch 24 can only be closed if the blast key is in circuit and connected to the blast control unit 12 which then automatically assumes control of the switch 24 and the blast energy generator 22.

The optional control logic unit 26 provides an added state of logic which validates the remainder of the control equipment which is used together with the blast energy source.

The invention claimed is:

1. A blasting arrangement which includes (a) a plurality of detonators, (b) a blast control unit which is directly connected to the plurality of detonators and which contains a first energy source, the blast control unit being physically incapable of directly providing a voltage at a level which is suitable for arming the detonators, and (c) a blast key which is removably connected to the blast control unit and which includes a blast energy generator and optionally contains an on-board energy source, wherein, when the blast key is connected to the blast control unit, the blast energy generator is operable to produce a voltage at a level which is suitable for arming the detonators (i) by using energy selected from the first energy source in the blast control unit and (ii), when the on-board energy source is present, by using energy selected from one or both of the first energy source in the blast control unit and the on-board energy source in the blast key.

2. A blasting arrangement according to claim 1 further comprising a control logic unit which is responsive to at least one external control device to have the blast energy generator produce the voltage at a level which is suitable for arming the detonators.

3. A blasting arrangement according to claim 2 wherein the external control device is selected from manually operable input devices and communication links which are connected to the control logic unit.

4. A blasting arrangement according to claim 3 wherein the blast key includes a body and the manually operable input devices are mounted to the body.

5. A blasting arrangement according to claim 1 wherein the energy for producing the voltage at a level which is suitable for arming the detonators is provided solely from the on-board source in the blast key.

6. A blasting arrangement which includes a plurality of detonators, a blast control unit which is directly connected to the plurality of detonators and which is physically incapable of directly providing a voltage at a level which is suitable for arming the detonators, and a blast key which is removably connected to the blast control unit and which includes a blast energy generator and a switch which controls operation of the blast energy generator, wherein, when the blast key is connected to the blast control unit, the blast energy generator is operable to produce a voltage at a level which is suitable for arming the detonators using energy selected from one or both of a source in the blast key and a source in the blast control unit.

7. A blasting arrangement according to claim 6 wherein the switch is selected from a manual switch, an electronic switch and an electromechanical switch.

8. A blasting arrangement according to claim 6 which includes a control logic unit for controlling operation of the switch.

9. A blasting arrangement according to claim 8 wherein the control logic unit is responsive to at least one external control device.

10. A blasting arrangement according to claim 9 wherein the external control device is selected from manually operable input devices and communication links which are connected to the control logic unit.

11. A blasting arrangement according to claim 10 wherein the blast key includes a body and the manually operable input devices are mounted to the body.

12. A blasting arrangement according to claim 6 wherein the energy for producing the voltage at a level which is suitable for arming the detonators is provided solely from an on-board source in the blast key.

13. A blasting arrangement according to claim 6 wherein the blast key comprises a housing within which the blast energy generator and, optionally, an on-board energy source, are enclosed.

* * * * *